US008298342B2

(12) United States Patent
Haas et al.

(10) Patent No.: US 8,298,342 B2
(45) Date of Patent: Oct. 30, 2012

(54) DUSTING METHOD AND CORRESPONDING DUSTING DEVICE

(75) Inventors: Juergen Haas, Knittlingen (DE); Alexander Meissner, Stuttgart (DE); Marcus Frey, Weil Der Stadt (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 299 days.

(21) Appl. No.: 12/681,264

(22) PCT Filed: Oct. 1, 2008

(86) PCT No.: PCT/EP2008/008321

§ 371 (c)(1),
(2), (4) Date: Apr. 1, 2010

(87) PCT Pub. No.: WO2009/046916

PCT Pub. Date: Apr. 16, 2009

(65) Prior Publication Data

US 2010/0242991 A1 Sep. 30, 2010

(30) Foreign Application Priority Data

Oct. 2, 2007 (DE) ..... 10 2007 047 190

(51) Int. Cl.
*E01H 1/02* (2006.01)
*B08B 7/00* (2006.01)

(52) U.S. Cl. ..... 134/6; 134/42; 15/22.3; 15/77; 15/80

(58) Field of Classification Search ..... None
See application file for complete search history.

(56) References Cited

U.S. PATENT DOCUMENTS 4,558,480 A 12/1985 Okafuji et al.
4,697,978 A * 10/1987 Tada et al. ..... 414/729
5,507,876 A 4/1996 Wandres
5,525,027 A 6/1996 Jinno et al.

(Continued)

FOREIGN PATENT DOCUMENTS

DE 4314046 A1 11/1994

(Continued)

OTHER PUBLICATIONS

International Search Report for PCT/EP2008/008321 dated Jan. 29, 2009.

(Continued)

*Primary Examiner* — Michael Kornakov
*Assistant Examiner* — Nicole Blan
(74) *Attorney, Agent, or Firm* — Rader Fishman & Grauer

(57) ABSTRACT

A dedusting device and method is disclosed for the dry or moist dedusting (i.e., cleaning, dusting, or removal of dirt, dust, or other debris) from components, e.g., of motor vehicles. An exemplary method may generally include positioning a dusting tool driven by a drive motor in a predetermined dusting position such that the tool contacts or touches the component, and determining a first operating variable of the drive motor of the dusting tool when positioning the dusting tool in the predetermined dusting position. The first operating variable may reflect a mechanical load of the drive motor due to the contact with the component to be dusted. The method may further include calculating a corrected dusting position as a function of the predetermined dusting position and the first operating variable of the drive motor, and positioning the dusting tool in the corrected dusting position.

17 Claims, 3 Drawing Sheets

U.S. PATENT DOCUMENTS

| | | | | |
|---|---|---|---|---|
| 5,720,069 | A | 2/1998 | Wanner et al. | |
| 2001/0001886 | A1* | 5/2001 | Ueki et al. | 15/77 |
| 2005/0005374 | A1* | 1/2005 | Weber et al. | 15/21.1 |
| 2006/0090774 | A1* | 5/2006 | Sugarman et al. | 134/6 |
| 2007/0124878 | A1* | 6/2007 | Rodrigues et al. | 15/97.3 |

FOREIGN PATENT DOCUMENTS

| | | | |
|---|---|---|---|
| DE | 4428069 | A1 | 3/1995 |
| DE | 4433925 | A1 | 3/1996 |
| DE | 19920250 | A1 | 11/2000 |
| DE | 10329499 | B3 | 8/2004 |
| DE | 10360649 | A1 | 4/2005 |
| GB | 2093234 | A | 8/1982 |

OTHER PUBLICATIONS

Article—Regarding Error Compensation and Path Correction for a Mobile Large Manipulator Application; Presented by Dipl. Ing. Klaus Dieter Rupp of Ingelfingen; 1996; p. 65. (English Abstract, 2 pages).

* cited by examiner

DUSTING METHOD AND CORRESPONDING DUSTING DEVICE

CROSS-REFERENCE TO RELATED APPLICATIONS

This application is a National Phase application claiming the benefit of International Application PCT/EP 2008/008321 filed Oct. 1, 2008, which claims priority to German Patent Application No. DE 102007047190.6, filed Oct. 2, 2007, the complete disclosures of which are hereby incorporated in by reference in their entireties.

BACKGROUND

The present disclosure relates to a dusting method, for example for the moist cleaning of motor vehicle body components before painting.

Furthermore, the present disclosure relates to a corresponding dusting device which is suitable for the moist cleaning of motor vehicle body components and has a sword brush as a dusting tool, for example.

In painting installations for motor vehicle body components, the motor vehicle body components must generally be dusted before painting the components. In some examples so-called sword brushes can be used for dusting the components, for example as described generally in DE 43 14 046 A1 and DE 103 29 499 B3. The sword brush is typically mounted on a hand wrist of a multi-axis robot and is guided by the robot over the surfaces to be dusted of the motor vehicle body components to be painted. In some examples, the sword brush dedusts the surfaces to be dusted using moisture.

One disadvantage of using sword brushes for dusting motor vehicle body components is the generally low tolerance of sword brushes with regards to a penetration depth relative to a surface being dusted. On the one hand, the cleaning brushes attached on the rotating brush belt of the sword brush must touch the surfaces to be dusted, in order to remove dust from the surfaces. On the other hand, a certain spacing between the rotating dusting belt of the sword brush and the surface to be dusted should generally not fall below a predetermined minimum distance, as the dusting brushes are generally deformed to a greater extent with increasing penetration depth, which can lead to damage to the cleaning brushes and, in the worst case, to a collision between the sword brush or hard components thereof and the component to be dusted.

Furthermore, the cleaning result using a sword brush is generally dependent on the penetration, wherein an optimal cleaning result can only be achieved if the penetration depth remains within a certain predetermined range.

The generally low positioning tolerance of known sword brushes is problematic in particular because the positioning of the motor vehicle body components to be dusted in a painting installation is only possible with a relatively low positioning accuracy, which must be accommodated by the sword brush.

One reason for the low positioning accuracy of the motor vehicle body components to be dusted consists in the fact that the motor vehicle body components themselves can have tolerances in terms of their dimensions of up to a centimeter (1 cm), which cannot be changed.

A further reason for the low positioning accuracy of the motor vehicle body components to be dusted is that the conveying technology used to transport motor vehicle bodies or components thereof is itself subject to tolerances, which may only be changed with great difficulty and or large investment in the conveying technology.

Finally, another reason for the low positioning accuracy of the motor vehicle body components to be dusted is that the motor vehicle body components are transported by a skid that is also subject to positioning tolerances.

The tolerance deviations in the case of the positioning of the motor vehicle body components to be dusted therefore often exceed the tolerance compensation abilities of the sword brush, and periodically lead to a production stop caused by the triggering of collision protection, e.g., between sword brushes and a motor vehicle body component.

An aircraft washing installation is disclosed by Klaus Dieter Rupp: "Zur Fehlerkompensation and Bahnkorrektur für eine mobile Grolβmanipulator-Anwendung", Springer-Verlag (1996), in the case of which aircraft washing installation, a washing brush is guided by a large manipulator over the aircraft surfaces to be washed. Here also, the penetration depth of the washing brush must be kept within a certain tolerance in order to avoid a collision between the washing brush and the aircraft to be cleaned on the one hand and to achieve a good washing action on the other hand. This publication generally controls the penetration depth of the washing brush as a function of the torque of a washing brush motor. So, the torque of the washing brush motor likewise increases with increasing penetration depth, as the brushes of the washing brush are deformed to a greater extent with increasing penetration depth. The torque of the washing brush motor is therefore a measure for the penetration depth and can therefore be used as a measurement variable.

This known controlling of the penetration depth as a function of the torque of the drive motor has not been applied to sword brushes for various reasons.

On the one hand, the tolerance field of the penetration depth is significantly smaller in the case of sword brushes than in the case of the previously mentioned large washing installations for aircraft.

On the other hand, sword brushes are not only used for dusting planar surfaces typical of the larger aircraft applications, but rather are also used for the dusting of curved surfaces. It has been shown however that the driving torque of the sword brush motor alone is generally not a suitable measure for the penetration depth if curved surfaces are dusted.

Finally, cleaning devices for large objects such as aircraft and/or ships are known from U.S. Pat. No. 5,525,027, DE 44 28 069 A1 and DE 44 33 925 A1, in the case of which cleaning devices, the contact pressure of a cleaning brush is measured and controlled. These cleaning devices are not dusting devices in the sense according to the invention, however. Furthermore, these cleaning devices are not suitable for cleaning motor vehicle body components in a painting installation.

BRIEF DESCRIPTION OF THE DRAWINGS

The present disclosure will be further explained using the exemplary illustrations shown in the figures. In the figures.

DETAILED DESCRIPTION

Figure 1A:
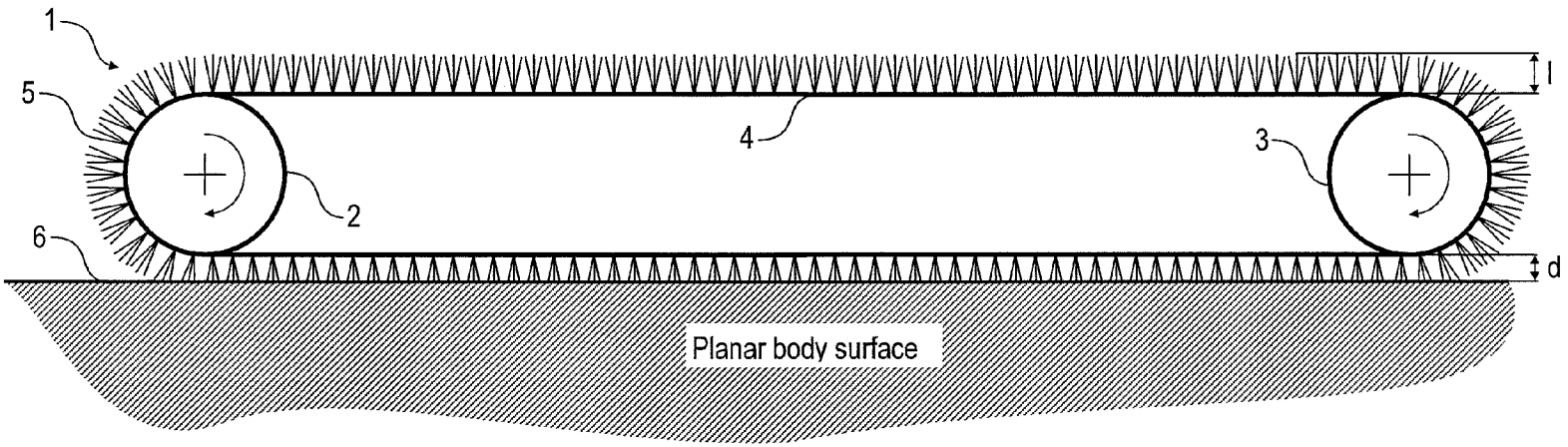
FIG. 1A shows a simplified cross-sectional view of an exemplary brush, e.g., a sword brush, for dusting motor vehicle body components on a planar body surface.

The exemplary illustrations are generally based on the object of achieving a positioning tolerance which is as large as possible when using a brush, e.g., a sword brush, for dedusting (i.e., cleaning, dusting, or otherwise removing dust, dirt, debris, etc.) motor vehicle body components, in order to avoid disruptive production stops caused by the triggering of collision protection systems.

The exemplary illustrations may control of a penetration depth of a dusting brush, e.g., a sword brush, by taking a driving torque of a brush motor into account, for example as mentioned above regarding the dissertation of Klaus Dieter Rupp of a dusting device for motor vehicle body components. This is generally made possible in the exemplary illustrations by determining and taking into account a surface shape of the component to be dusted during a position correction process. The effects of various designs of the surfaces to be dusted on the torque of the sword brush motor, which effects are independent of the penetration depth, may also be taken into account in this manner.

The exemplary illustrations therefore generally provide a dusting method, in which a dusting tool (e.g. a sword brush) driven by a drive motor is brought into a predetermined dusting position, so that the dusting tool touches and dedusts the component to be dusted. The predetermined dusting position is generally a path point on a robot path, which can be programmed (taught) by an operator.

In the case of the positioning of the dusting tool in the predetermined dusting position, in the dusting method according to the exemplary illustrations, a first operating variable (e.g., the torque) of the drive motor of the dusting tool is determined, wherein the first operating variable reproduces the mechanical loading of the drive motor by the contact of the dusting tool with the component to be dusted.

In dependence, at least partially, upon the predetermined dusting position and the determined first operating variable of the drive motor, a corrected dusting position may then be determined, which takes position tolerances of the motor vehicle body components to be dusted into account, thereby enabling a narrow tolerance field for the penetration depth of the sword brush.

The dusting tool may then be brought into a corrected dusting position.

In one exemplary illustration, the corrected dusting position is not only calculated as a function of the first operating variable of the drive motor and the predetermined dusting position, but also as a function of a form factor which reproduces a surface shape of the component to be dusted at the predetermined dusting position. More specifically, because the surface shape of the motor vehicle body component to be dusted, in addition to the penetration depth, likewise influences the load torque of the drive motor, this surface shape may be taken into account during the calculation of the corrected dusting position. In one illustration, the form factor can be established using a sensor measuring a deflection of a dusting belt of the sword brush, as a convex surface of the components to be dusted in the case of an otherwise identical penetration depth leads to a greater deflection of the dusting belt than a planar surface of the components to be dusted.

In one exemplary illustration, a second operating variable (e.g. the speed) of the drive motor of the dusting tool is additionally determined and likewise taken into account during the calculation of the corrected dusting position. The corrected dusting position may therefore be calculated as a function of the predetermined dusting position, the first operating variable (e.g. the torque) and the second operating variable (e.g. the speed) of the drive motor of the dusting tool.

An exemplary dusting tool may be a sword brush having a dusting belt beset with brushes, which is guided around two deflection rollers. Sword brushes of this type are, for example, generally known from DE 43 14 046 A1 and DE 103 29 499 B3, so that reference is made with regard to the structure and the functioning of sword brushes to these two publications, each of which are hereby expressly incorporated by reference in their entireties.

The concept of a dusting used in the context of the exemplary illustrations is not limited to a fluid-free dusting. Rather, some exemplary illustrations may utilize a cleaning and antistatic fluid applied to the surfaces to be dusted during the dusting in order to improve the cleaning action, e.g., as generally described by DE 199 20 250 A1, which is hereby expressly incorporated by reference in its entirety. In these exemplary illustrations, a fluid film is generally applied to component surfaces to be dusted during the dusting. The concept of dusting, however, may generally be differentiated from washing processes which generate more than a fluid film on the component surface, e.g., by applying relatively large amounts of a washing fluid. Accordingly, exemplary dusting processes may include both dry dusting and wet dusting processes.

The exemplary illustrations are not limited to dusting methods and dusting devices in which a sword brush is used as the dusting tool. Rather, the exemplary illustrations also include other types of dusting tools.

Further, the exemplary illustrations are not limited to dusting methods and dusting devices in which the corrected dusting position is calculated as a function of the torque and the speed of the sword brush motor and as a function of the surface shape of the component to be dusted. Rather, other operating variables of the dusting tool can also be taken into account during the calculation of a corrected dusting position.

An exemplary dusting tool may generally be positioned by a multi-axis dusting robot, wherein, in the case of a sword brush, the mounting of the sword brush on a hand wrist of the dusting robot is particularly advantageous.

In the case of the exemplary dusting methods, components to be dusted may be transported along a conveying route past the dusting robot by means of a conveyor. Here, the conveyor likewise may have positioning tolerances or inaccuracies which are added to the positioning inaccuracies already mentioned above, and therefore may likewise be compensated or tolerated by the dusting tool. In the exemplary illustrations, the position of the component to be dusted on the conveying route may be determined, for example by using a position sensor. The corrected dusting position may then also be calculated as a function of the determined position of the component to be dusted. In this manner, a positioning inaccuracy or tolerance of the conveyor can be compensated and thus may not have to be accommodated by the dusting tool.

Sensors may include, merely as examples, ultrasound sensors, optical sensors, force sensors or strain gauges (SG). The exemplary illustrations are not limited to the previously mentioned sensor types, however, but rather can also be realised with other sensor types.

Further, a correction of the dusting position may advantageously occur continuously (e.g., in real time or near-real time) during the positioning of the dusting tool, in order to maintain the penetration depth of the sword brush within a predetermined tolerance field or range.

Finally, the exemplary illustrations not only comprise the previously described dusting method, but also a dusting device, in the case of which the dusting position is corrected by means of an adaption unit in order to maintain a penetration depth of the dusting device within a predetermined tolerance field or range.

The adaption unit in this case continuously calculates a corrected dusting position as a function of the first operating variable (e.g., a motor torque), the second operating variable (e.g., a speed) of the drive motor of the dusting tool and/or as a function of the form factor which reproduces the surface shape of the component to be dusted.

Furthermore, the exemplary illustrations also comprise a painting installation with one or a plurality of paint booths and an exemplary dusting device.

Figure 1B:
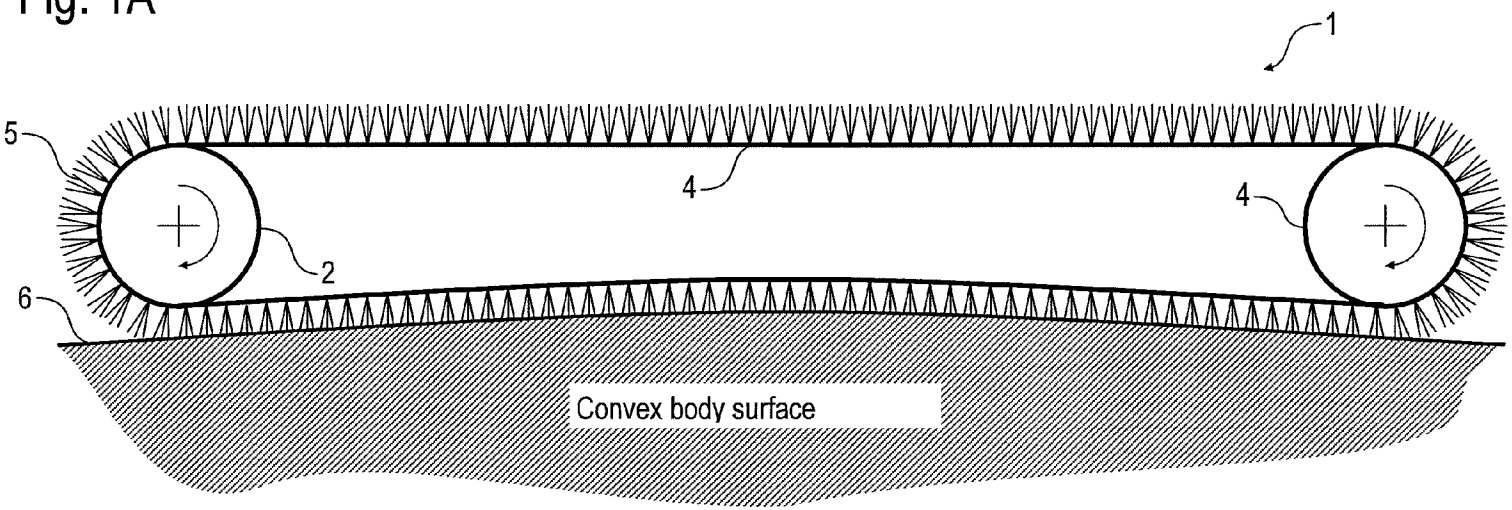
FIG. 1B shows the exemplary brush of FIG. 1A on a convex body surface.

The FIGS. 1A and 1B show a sword brush 1 in a simplified form, e.g., as described for example in the above-mentioned DE 43 14 046 A1 and DE 103 29 499 B3 publications, so that reference is also made with regard to the further details of the sword brush 1 in these publications, the content of which is to be included in the present description in full with regard to the structure and the functioning of the sword brush 1.

The sword brush 1 has two parallel deflection rollers 2, 3 around which a dusting belt 4 is guided, wherein the dusting belt 4 carries dusting brushes 5 on its outside.

For dusting a body surface 6, the sword brush 1 is positioned in such a manner that the dusting brushes 5 of the lower, pulled side of the dusting belt 4 generally press against the body surface 6. The dusting brushes 5 have a free length 1 here in an unloaded state, whilst a spacing d is located between the lower, pulled side of the dusting belt 4 and the body surface 6 to be dusted. A penetration depth T may be determined by subtracting the spacing d from the free length 1, i.e., T=1−d. Generally it may be desired that the penetration depth T remain within a predetermined tolerance field. More specifically, a penetration depth T which is too low may lead to an unsatisfactory dusting action, whereas a penetration depth T which is too large may cause a strong wearing of the dusting brushes 5. Furthermore, the penetration depth T also has an influence on the cleaning result, wherein an optimum cleaning result requires that the penetration depth T lies within a minimum penetration depth $T_{MIN}$ and a maximum penetration depth $T_{MAX}$, such that $T_{MIN}<T<T_{MAX}$.

FIG. 1A here shows the use of the sword brush 1 for dusting a planar body surface 6, whereas the body surface in FIG. 1B is convex, which leads to a deflection $a_{ACT}$ of the lower, pulled side of the dusting belt 4. The deflection $a_{ACT}$ of the lower, pulled side of the dusting belt 4 increases a torque $M_{ACT}$ acting on a drive motor 7 of the sword brush 1. Accordingly, exemplary dusting methods may generally evaluate the torque $M_{ACT}$ of the drive motor 7 of the sword brush 1 as a measure for the penetration depth T of the sword brush 1, in order to compensate position tolerances of the body surface 6 to be dusted.

Figure 2:
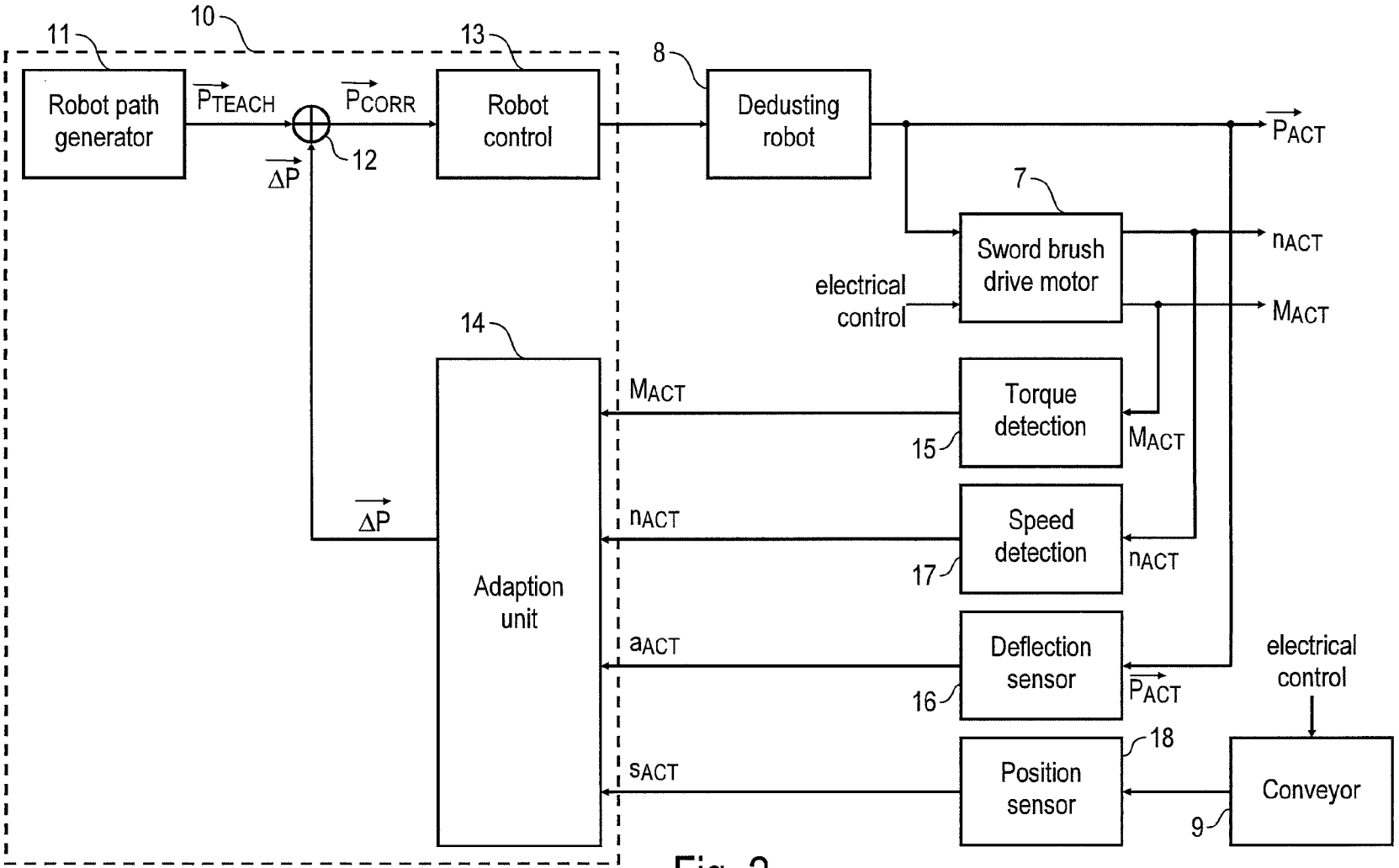
FIG. 2 shows a control engineering equivalent circuit diagram of an exemplary dusting device.

The exemplary illustrations are now explained in further detail on the basis of the exemplary control engineering equivalent circuit diagram in FIG. 2.

The sword brush 1 is mounted on a multi-axis hand wrist of a multi-axis dusting robot 8, which enables a free positioning of the sword brush 1.

Motor vehicle body components may be transported past the dusting robot 8 by a linear conveyor 9 along a conveying route, so that the dusting robot 8 can guide the sword brush 1 over the body surfaces 6 to be dusted.

A current spatial position and orientation of the sword brush 1 is here represented by a position vector $\vec{P}_{ACT}$ that may be controlled by a control unit 10 in accordance with a predetermined taught robot path.

To this end, the control unit 10 has a robot path generator 11 which outputs position vectors $\vec{P}_{TEACH}$ for previously programmed robot paths, which position vectors generally define the position of a tool centre point (TCP) of the sword brush 1, as well as the orientation of the sword brush 1 for individual path points.

The position vectors $\vec{P}_{TEACH}$ may then be converted by a control feedback loop, e.g., using an adder 12 with a correction value $\Delta\vec{P}$, to a corrected position vector $\vec{P}_{CORR}$, as is described in more detail below.

The corrected position vectors $\vec{P}_{CORR}$ in the spatial coordinates may then be fed to a robot control 13 which converts the spatial coordinates into axial coordinates and controls the dusting robot 8 accordingly.

Furthermore, the control unit 10 may include an adaption unit 14 which calculates the correction value $\Delta\vec{P}$ and compensates positioning inaccuracies of the body surfaces 6 to be dusted as a result.

For example, during the calculation of the correction value $\Delta\vec{P}$, the torque $M_{ACT}$ of the drive motor 7 of the sword brush 1 may increase with the penetration depth T, as the dusting brushes 5 must be deformed to a greater extent with increasing penetration depth T. The torque $M_{ACT}$ may therefore be suitable as a measurement variable for the setting of the penetration depth T of the sword brush, at least in part.

The exemplary dusting device therefore may include a torque sensor 15 which establishes the torque $M_{ACT}$ of the drive motor 7 of the sword brush 1 and forwards it to the adaption unit 14 for evaluation. It is alternatively possible that the torque $M_{ACT}$ is not measured by a separate torque sensor 15, but rather is derived from electrical operating variables of the drive motor 7, so that a separate torque sensor 15 is not required.

The torque $M_{ACT}$ of the drive motor 7 of the sword brush 1 may be influenced not only by the penetration depth T of the sword brush 1, but also by a shape of the body surface 6 to be dusted. For example, the convex body surface 6 according to FIG. 1B generally causes a larger torque $M_{ACT}$ than the planar body surface 6 according to FIG. 1A where the penetration depth T is generally equal.

FIG. 1B shows an idealised state in which the penetration depth is constant over the entire length of the sword brush 1. In practice, the penetration depth T may vary over the length of the sword brush 1, however, as the dusting brushes 5 may generally act as spring elements.

The adaption unit 14 therefore may take not only the torque $M_{ACT}$ of the drive motor 7 of the sword brush into account, but also a deflection $a_{ACT}$ of the lower, pulled side of the dusting belt 4, during the calculation of a correction value $\Delta\vec{P}$. The deflection $a_{ACT}$ may form a form factor which reproduces the surface shape of the body surface 6 to be dusted. The deflection $a_{ACT}$ of the lower, pulled side of the dusting belt may be measured by a deflection sensor 16, which can be an optical sensor or as an ultrasound sensor, for example.

Furthermore, the dusting device in this exemplary illustration may include a speed sensor 17 which measures a speed $n_{ACT}$ of the drive motor 7 of the sword brush 1 and forwards it to the adaption unit 14, so that the speed $n_{ACT}$ is also taken into account during the calculation of the correction value $\Delta\vec{P}$.

As described above, the motor vehicle body parts to be dusted may be transported past the dusting robot 8 by a linear conveyor 9 along a conveying route, wherein the linear conveyor 9 likewise has positioning inaccuracies which may be accommodated or compensated by the exemplary dusting device. The exemplary dusting device therefore may include a position sensor 18 which measures a position $s_{ACT}$ of the motor vehicle body components to be dusted along the conveying route and forwards it to the adaption unit 14. The adaption unit 14 then calculates the correction value $\Delta\vec{P}$, also as a function of the measured position $s_{ACT}$ of the motor vehicle body components to be dusted on the conveying route, as a result of which, positioning inaccuracies of the linear conveyor 9 are further compensated.

Figure 3:
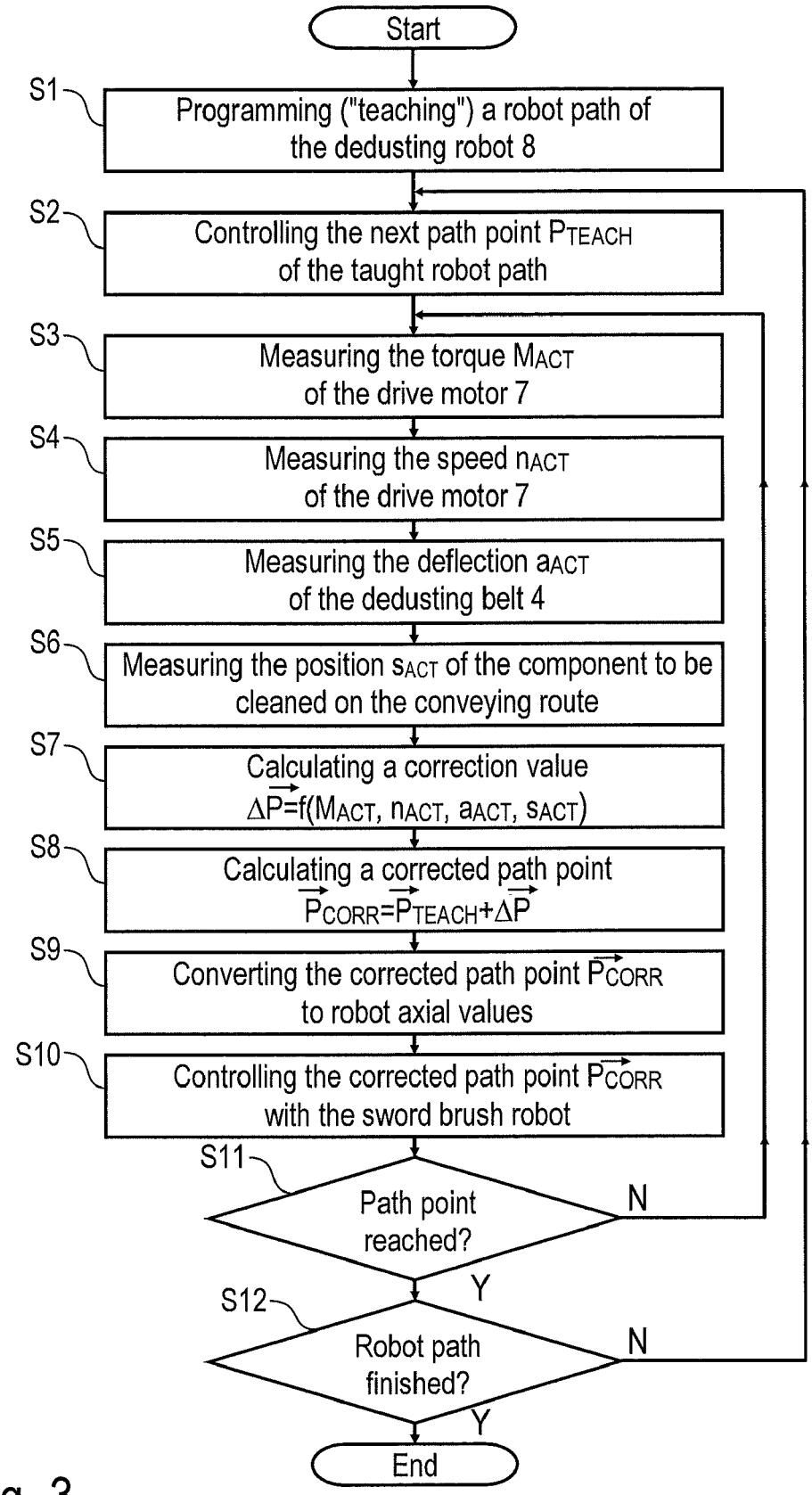
FIG. 3 shows a process flow diagram of an exemplary dusting method.

An exemplary dusting method will now be explained briefly in accordance with the flow chart in FIG. 3.

In block S1, a robot path may be initially programmed ("taught") in any manner that is convenient. In the programming of the robot path in the step S1, position tolerances of the motor vehicle body components to be dusted may not yet be taken into account.

The programming of the desired robot path may take place offline, i.e., without the dusting robot executing an actual movement. Merely as one example, programming software "3D-OnSite" commercially available from the applicant can be used for this purpose.

Proceeding to block S2, a next path point $\vec{P}_{TEACH}$ in each case on the previously programmed robot path is controlled.

During the controlling of the next path point $\vec{P}_{TEACH}$ the torque $M_{ACT}$ of the drive motor 7 of the sword brush 1, the speed $n_{ACT}$ of the drive motor 7 of the sword brush 1, the deflection $a_{ACT}$ of the lower, pulled side of the dusting belt 4 and/or the position $s_{ACT}$ of the motor vehicle body component to be dusted on the conveying route may be measured in blocks S3 to S6. As generally described above, exemplary methods may include any one or more of the blocks S3 to S6.

Proceeding to block S7, a correction value $\Delta\vec{P}$ may be calculated from the previously measured value(s), wherein the calculation of the correction value $\Delta\vec{P}$ can take place on the basis of predetermined characteristics.

Proceeding to block S8, a corrected path point $\vec{P}_{CORR}$ may be calculated from the predetermined path point $\vec{P}_{TEACH}$ and the correction value $\Delta\vec{P}$.

In block S9, the robot control 13 may convert the corrected path point $\vec{P}_{CORR}$ from the spatial coordinates into axial coordinates, and control the dusting robot 8 accordingly in block S10.

The steps S3 to S10 may be repeated in a loop until it is determined, e.g., in block S11, that the corrected path point $\vec{P}_{CORR}$ has been reached.

In block S12, it may be determined whether a predetermined robot path is ended. If this is not the case, then the steps S2 to S11 may be repeated in a loop, wherein the next path point $\vec{P}_{TEACH}$ of the predetermined robot path is controlled in each case.

The invention is not limited to the previously described exemplary embodiment. Rather, a multiplicity of variants and variations are possible, which likewise make use of the inventive idea and therefore come under the protective scope.exemplary illustrations are not limited to the specific examples described above. Rather, a plurality of variants and modifications are possible, which likewise make use of the concepts of the exemplary illustrations and therefore fall under the scope of protection. Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. A method for dusting components, comprising:

positioning a dusting tool driven by a drive motor in a predetermined dusting position, so that the dusting tool contacts the component to be dusted;

determining a first operating variable of the drive motor of the dusting tool during the positioning of the dusting tool in the predetermined dusting position, wherein the first operating variable reproduces a mechanical loading of the drive motor by the contact with the component to be dusted;

determining a form factor, the form factor representing a surface shape of the component to be dusted at the predetermined dusting position;

calculating a corrected dusting position as a function of at least the predetermined dusting position and the first operating variable of the drive motor; and positioning the dusting tool in the corrected dusting position wherein calculating the corrected dusting position includes calculating the corrected dusting position as a function of at least the form factor.

2. The method according to claim 1, further comprising:

establishing a second operating variable of the drive motor of the dusting tool during the positioning at the predetermined dusting position;

wherein calculating the corrected dusting position includes calculating the corrected dusting position as a function of at least the established second operating variable of the drive motor.

3. The method according to claim 1, wherein the dusting tool is a sword brush which has a dusting belt beset with brushes, the dusting belt guided around two deflection rollers.

4. The method according to claims 1, further comprising:

determining a form factor, the form factor representing a surface shape of the component to be dusted at the predetermined dusting position;

establishing a second operating variable of the drive motor of the dusting tool during the positioning at the predetermined dusting position;

wherein calculating the corrected dusting position includes calculating the corrected dusting position as a function of at least the form factor and the established second operating variable of the drive motor;

wherein the first operating variable is a torque of the drive motor, the second operating variable is a speed of the drive motor, and the form factor represents a deflection of a dusting belt.

5. The method according to claim 1, wherein the dusting tool is positioned by a multi-axis dusting robot.

6. The method according to claim 1, further comprising:

transporting the component to be dusted along a conveying route past a dusting robot by means of a conveyor; and establishing a position of the component to be dusted on the conveying route;

wherein calculating the corrected dusting position includes calculating the corrected dusting position as a function of at least the established position of the component to be dusted.

7. The method according to claim 6, further comprising:

determining a form factor, the form factor representing a surface shape of the component to be dusted at the predetermined dusting position;

transporting the component to be dusted along a conveying route past the dusting robot by means of a conveyor; and establishing a position of the component to be dusted on the conveying route;

wherein calculating the corrected dusting position includes calculating the corrected dusting position as a function of at least the form factor and the established position of the component to be dusted; and wherein the form factor and the position of the component to be dusted is measured on the conveying route by a sensor.

8. The method according to claim 7, wherein the sensor is selected from a group consisting of:

an ultrasound sensor;

an optical sensor;

a force sensor; and a strain gauge.

9. The method according to claim 1, wherein the corrected dusting position is continuously calculated and corrected while the dusting tool is positioned.

10. A dusting device for the dusting of components, comprising:

a dusting tool with a drive motor;

a dusting robot configured to spatially position the dusting tool;

a robot controller configured to control the dusting robot in accordance with a predetermined dusting position;

a first sensor configured to establish a form factor, the form factor representing a surface shape of the component to be dusted at the predetermined dusting position; and an adaption unit configured to determine a corrected dusting position as a function of the predetermined dusting position and a first operating variable of the drive motor of the dusting tool at the predetermined dusting position, the dusting robot configured to position the dusting tool in the corrected dusting position;

wherein the adaption unit is configured to determine the corrected dusting position as a function of at least the form factor.

11. The dusting device according to claim 10, further comprising a second sensor configured to establish a second operating variable of the drive motor, wherein the adaption unit is configured to calculate the corrected dusting position as a function of at least the second operating variable.

12. The dusting device according to claim 10, wherein the dusting tool is a sword brush including a dusting belt beset with brushes, the dusting belt guided around two deflection rollers.

13. The dusting device according to claim 10, further comprising:

a first sensor configured to establish a form factor, the form factor representing a surface shape of the component to be dusted at the predetermined dusting position; and a second sensor configured to establish a second operating variable of the drive motor;

wherein the first operating variable is a torque of the drive motor, the second operating variable is a speed of the drive motor, and the form factor represents a deflection of the dusting belt.

14. The dusting device according to claim 10, further comprising:

a conveyor which transports the component to be dusted along a conveying route past the dusting robot; and a position sensor configured to determine a position of the component to be dusted on the conveying route;

wherein the adaption unit is configured to determine the corrected dusting position as a function of at least an established position of the component to be dusted on the conveying route.

15. The dusting device according to claim 14, further comprising:

a first sensor configured to establish a form factor, the form factor representing a surface shape of the component to be dusted at the predetermined dusting position; and a second sensor configured to establish a second operating variable of the drive motor;

wherein the first sensor, the second sensor, and the position sensor are each selected from a group consisting of:

an ultrasound sensor;

an optical sensor;

a force sensor; and a strain gauge.

16. The dusting device according to claim 10, wherein the dusting robot includes a multi-axis hand wrist, on which the dusting tool is mounted.

17. A painting installation with a dusting device according to claim 10.

* * * * *